US009466911B1

(12) United States Patent
Wu

(10) Patent No.: US 9,466,911 B1
(45) Date of Patent: Oct. 11, 2016

(54) TERMINAL BASE HAVING FASTENING STRUCTURE

(71) Applicant: DINKLE ENTERPRISE CO., LTD., New Taipei (TW)

(72) Inventor: Shang-Tsai Wu, New Taipei (TW)

(73) Assignee: DINKLE ENTERPRISE CO., LTD., New Taipei (TW)

( * ) Notice: Subject to any disclaimer, the term of this patent is extended or adjusted under 35 U.S.C. 154(b) by 0 days.

(21) Appl. No.: 14/885,510

(22) Filed: Oct. 16, 2015

(51) Int. Cl.
*H01R 4/24* (2006.01)
*H01R 13/42* (2006.01)

(52) U.S. Cl.
CPC ..... *H01R 13/42* (2013.01)

(58) Field of Classification Search
CPC ..... H01R 4/4818
USPC ..... 439/441
See application file for complete search history.

(56) References Cited

U.S. PATENT DOCUMENTS 6,146,217 A * 11/2000 Osada ..... H01R 4/4836 439/441
6,682,364 B2 * 1/2004 Cisey ..... H01R 9/2666 439/441
6,851,967 B2 * 2/2005 Miyoshi ..... H01R 4/4836 439/441
7,287,999 B2 * 10/2007 Holterhoff ..... H01R 4/4836 439/441
7,568,939 B2 * 8/2009 Diekmann ..... H01R 4/4818 439/438
7,648,371 B2 * 1/2010 Boensch ..... H01L 31/02013 439/76.1
8,113,858 B1 * 2/2012 Chiang ..... H01R 4/4845 439/188
8,251,738 B2 * 8/2012 Heckert ..... H01R 4/4836 439/441
8,292,677 B2 * 10/2012 Gassauer ..... H01R 13/15 439/729
8,998,634 B2 * 4/2015 Koellmann ..... H01R 9/26 439/441

FOREIGN PATENT DOCUMENTS

| | | | |
|---|---|---|---|
| CN | 203026650 | U | 6/2013 |
| DE | 102008062137 | A1 | 6/2010 |
| DE | 202012104408 | U1 | 2/2014 |
| DE | 202015003298 | U1 | 6/2015 |

OTHER PUBLICATIONS

Search Report dated Apr. 28, 2016 of the corresponding European patent application.

* cited by examiner

*Primary Examiner* — Neil Abrams
(74) *Attorney, Agent, or Firm* — Chun-Ming Shih; HDLS IPR Services

(57) ABSTRACT

A terminal base (100) having a fastening structure includes a body (110), a conductive terminal (200), a metal elastic element (300), and a press block (170). The body (110) includes an accommodating space (120), a wiring hole (130), a receiving hole (140), and a hook element (150) disposed adjacent to the receiving hole (140). The wiring hole (130) and the receiving hole (140) communicate with the accommodating space (120). The hook element (150) is elastically connected to the body (110). The metal elastic element (300) includes a contact end (310) and a movable end (320), the contact end (310) is in contact with the conductive terminal (200), and the movable end (320) is elastically disposed inside the accommodating space (120). The press block (170) is movably disposed in the receiving hole (140), the press block (170) presses the movable end (320) to be engaged with the hook element (150).

11 Claims, 16 Drawing Sheets

TERMINAL BASE HAVING FASTENING STRUCTURE

TECHNICAL FIELD

The present invention relates to a terminal base and, in particular, to a terminal base allowing quick wiring or quick cable replacement.

BACKGROUND

Connecting elements for signal transmission are commonly used, which are, for example, terminal base structures used in an electronic device for connecting signal wires. In other words, in electronic devices, in order to achieve signal transmission between various electric components, it is required that signal wires/cables from different electric components be connected to one another to allow signal transmission among the same.

However, in a conventional terminal base structure, a maintenance staff has to press a press block by a screwdriver or other similar hand tool with one hand and insert a signal wire/cable with the other hand to make wiring. Such wiring therefore causes troubles and inconvenience to the maintenance staff. In particular, when arranging or replacing the wires/cables for a row of terminal bases, since there are no labor-saving structures providing assistance, wiring is extremely time and labor consuming.

Accordingly, the aim of this disclosure is to solve the above-mentioned problems to improve wiring in the conventional terminal base, which industry in related fields has attempted to solve.

SUMMARY

It is an object of the present invention to provide a terminal base having a fastening structure for arranging or replacing cables quickly and conveniently.

It is another object of the present invention to provide a terminal base having a fastening structure, which allowing cable arrangement/replacement with minimum manual labor or one hand only.

Accordingly, the present invention provides a terminal base having a fastening structure for collaborating with a cable having a core. The terminal base includes a body, a conductive terminal, a metal elastic element, and a press block. The body includes an accommodating space, a wiring hole, a receiving hole, and a hook element disposed adjacent to the receiving hole. The wiring hole and the receiving hole communicate with the accommodating space. The hook element is elastically connected to the body. The conductive terminal is disposed in the accommodating space. The conductive terminal includes two leads protruding outside of the body. The metal elastic element is disposed inside the accommodating space. The metal elastic element includes a contact end and a movable end. The contact end is in contact with the conductive terminal. The movable end is elastically disposed inside the accommodating space. The press block is movably disposed in the receiving hole. The press block presses the movable end of the metal elastic element to be engaged with the hook element.

It is preferable that the body further includes a stopper, and the stopper is fixed inside the accommodating space to position the conductive terminal.

It is preferable that the hook element includes an extension rod and a clasp portion connected to the extension rod, and the press block includes an engagement point at one side for engaged with the clasp portion.

BRIEF DESCRIPTION OF THE DRAWINGS

The disclosure will become more fully understood from the detailed description and the drawings given herein below for illustration only, and thus does not limit the disclosure, wherein.

DETAILED DESCRIPTION

Figure 1:
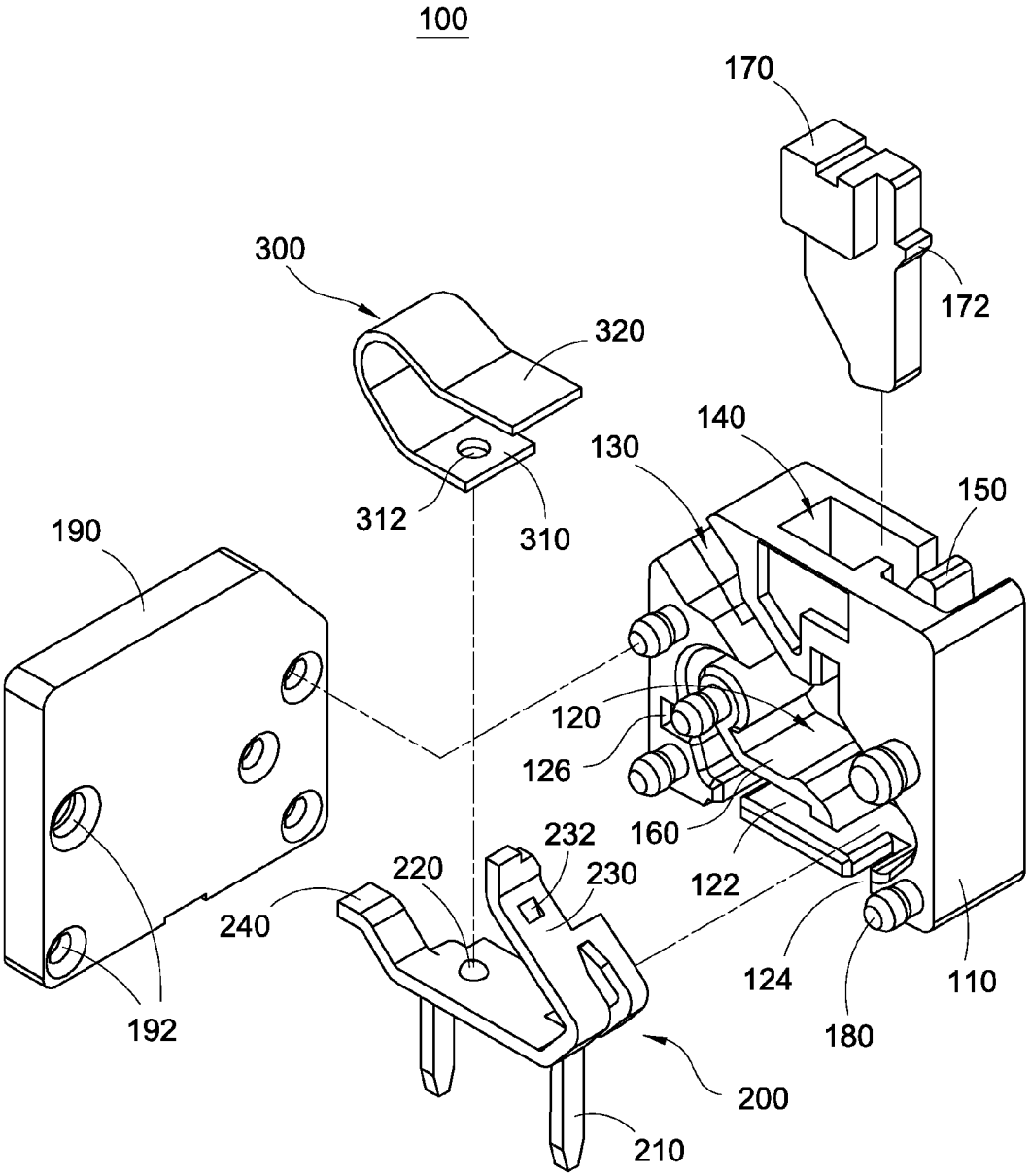
FIG. 1 is an exploded view showing a terminal base having a fastening structure according to a first embodiment of the present invention.
Figure 2:
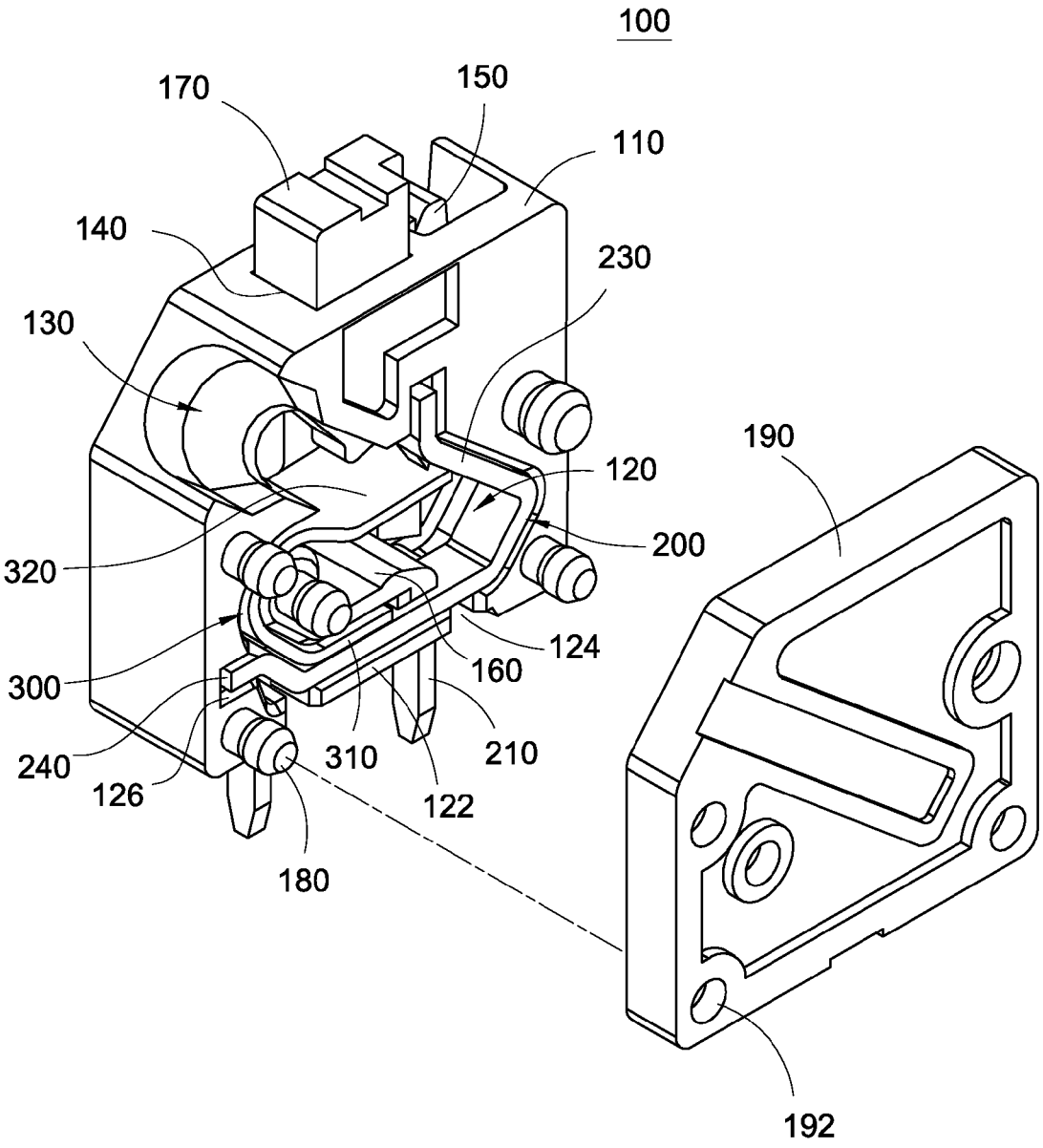
FIG. 2 is an exploded view of the present invention, showing a side cover separated from the terminal base having the fastening structure.
Figure 3:
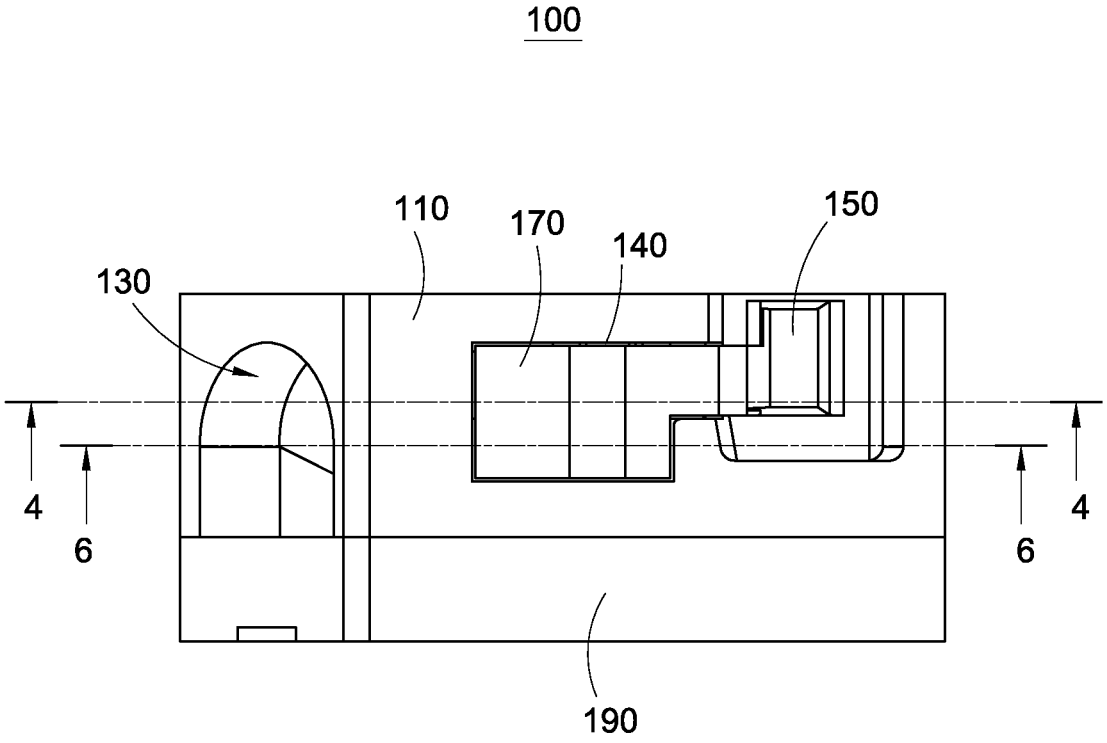
FIG. 3 is a top view of the present invention, showing the terminal base having the fastening structure.

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Referring to FIGS. 1 to 5, the present invention provides a terminal base 100 having a fastening structure for collaborating with a cable 10 having a core 12. The cable 10 includes an electric wire, a double insulated wire, other suitable signal wires, or etc. The terminal base 100 includes a body 110, a conductive terminal 200, a metal elastic element 300, and a press block 170. The body 110 includes an accommodating space 120, a wiring hole 130, a receiving hole 140, and a hook element 150 disposed adjacent to the receiving hole 140. The wiring hole 130 and the receiving hole 140 communicates with the accommodating space 120, and the hook element 150 is elastically connected to the body 110.

Figure 6:
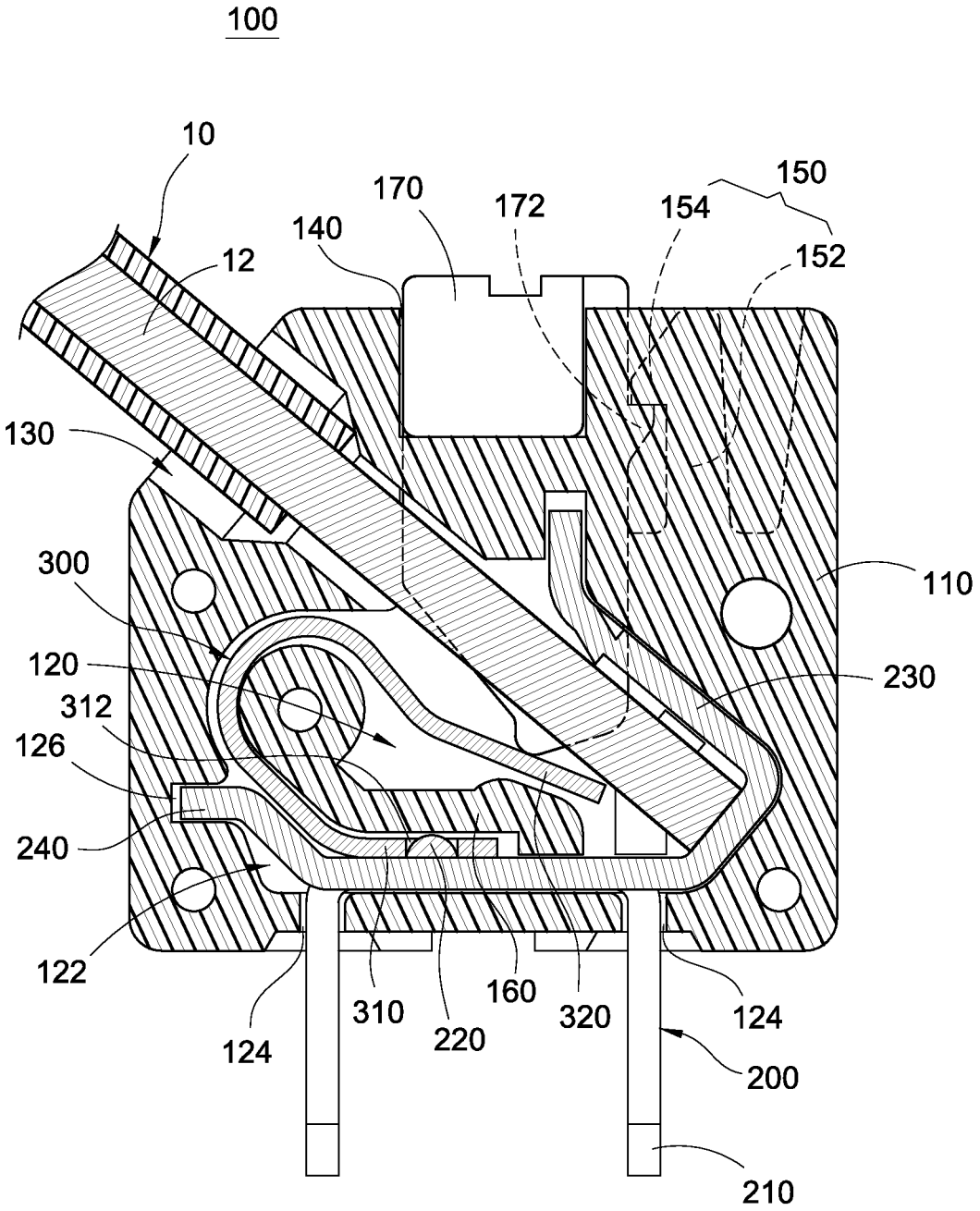
FIG. 6 is a cross-sectional view of the present invention, illustrating a core in contact with a bend portion and a metal elastic element.

The conductive terminal 200 made of copper or alloy thereof is disposed in the accommodating space 120. The conductive terminal 200 includes two leads 210 protruding outside of the body 110. The metal elastic element 300 is disposed inside the accommodating space 120. The metal elastic element 300 includes a contact end 310 and a movable end 320. Referring to FIG. 6, the conductive terminal 200 further includes a protrusion 220, and the contact end 310 includes a positioning hole 312 for the protrusion 220 to be positioned therein, whereby the contact end 310 is in contact with the conductive terminal 200, and the movable end 320 is elastically disposed inside the accommodating space 120.

Furthermore, the body 110 further includes a stopper 160, and the stopper 160 is fixed inside the accommodating space 120 to position the conductive terminal 200. In the present embodiment, one side surface of the stopper 160 corresponds in shape to the contact end 310 to limit movement of the contact end 310. The body 110 further provides a narrow cavity 122. The narrow cavity 122 and the accommodating space 120 communicate with each other and respectively accommodate the metal elastic element 300 and the conductive terminal 200. In the embodiment shown in FIGS. 5 and 6, it is preferable that a portion of the narrow cavity 122 fixes the metal elastic element 300 and the conductive terminal 200 at the same time to ensure smooth signal transmission.

Figure 8:
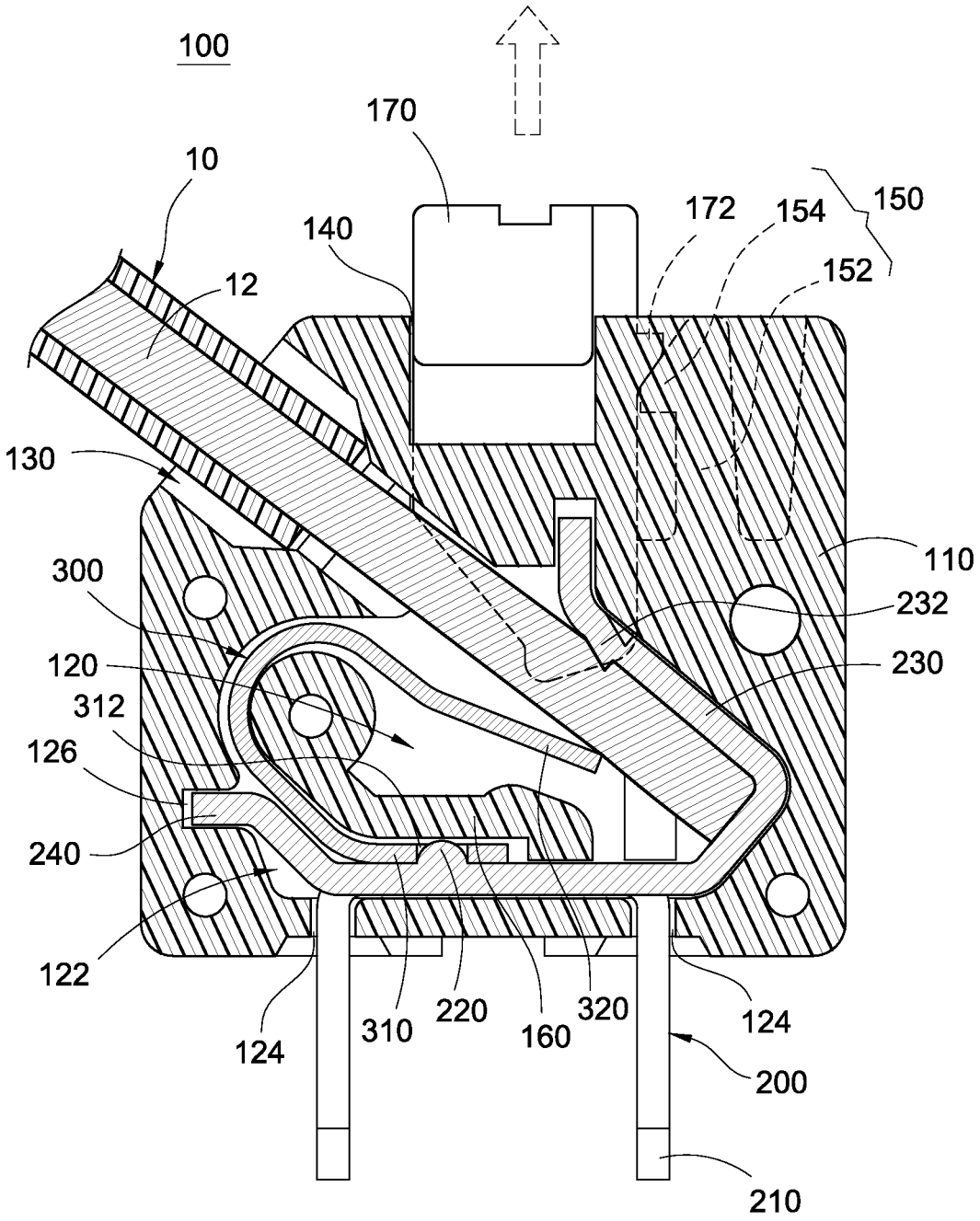
FIG. 8 is another operating view of FIG. 7.

In the embodiment, the body 110 further includes two openings 124 and a recess 126. The two openings 124 communicate with the narrow cavity 122. The two leads 210 protrude outside of the two openings and are positioned therein. The conductive terminal 200 includes an extension portion 240 positioned in the recess 126 and a bend portion 230 disposed in the accommodating space 120. The extension portion 240 and the bend portion 230 are respectively at two ends of the conductive terminal 200. Referring to FIG. 8, the bend portion 230 further includes a barb portion 232 toward the accommodating space 120 for securing the core 12.

Figure 4:
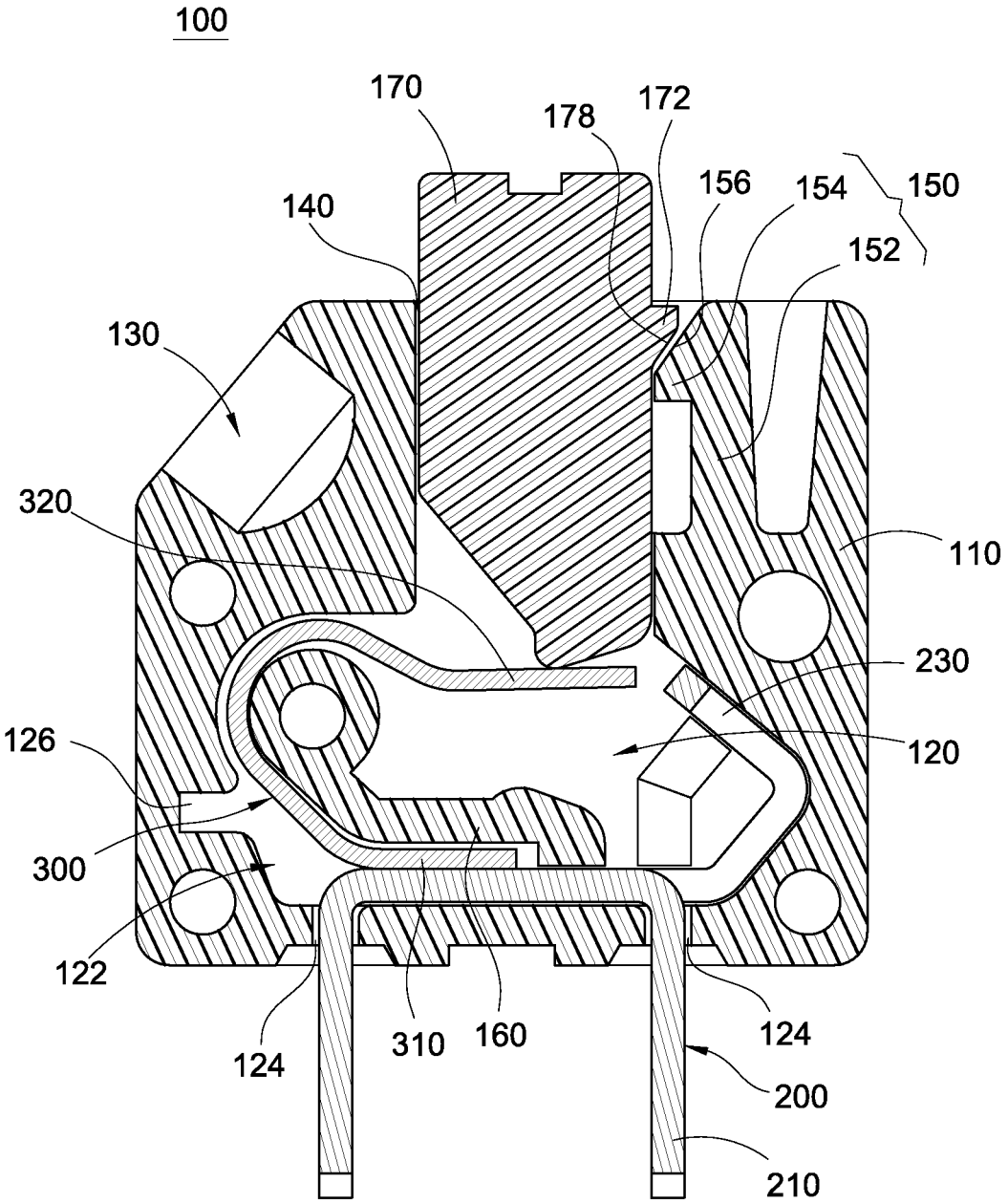
FIG. 4 is a cross-sectional view of the present invention, showing the terminal base having the fastening structure.
Figure 5:
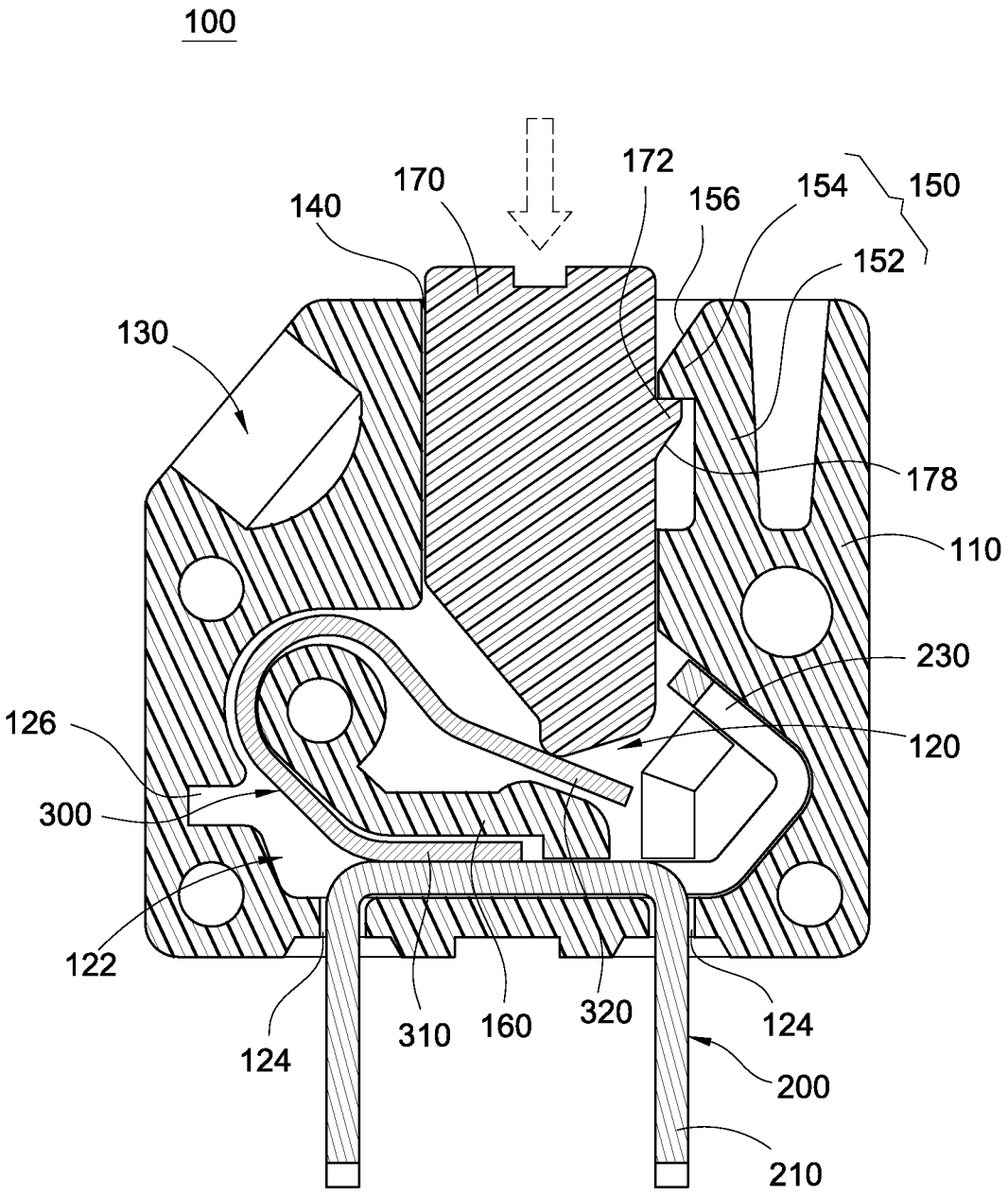
FIG. 5 is a cross-sectional view of the present invention, showing the press block engaged with the hook element.

Referring to FIGS. 4, 5, and 6, the press block 170 is movably disposed in the receiving hole 140, so the press block 170 can press the movable end 320 of the metal elastic element 300 to be engaged with the hook element 150. In the present embodiment, the hook element 150 integrally formed with the body 110 further includes an extension rod 152 and a clasp portion 154 connected to the extension rod 152. The press block 170 includes an engagement point 172 at one side for engaged with the clasp portion 154. The clasp portion 154 includes a first inclined surface 156. The press block 170 includes a second inclined surface 178 disposed corresponding to the first inclined surface 156.

When the engagement point 172 of the press block 170 contacts the clasp portion 154 to engage the same, the first inclined surface 156 easily moves against the second inclined surface 178, so that the hook element 150 is resiliently displaced to be engaged with the engagement point 172. At this point, the press block 170 keeps pressing the movable end 320 of the metal elastic element 300 to allow insertion of the core 12 of the cable 10 via the wiring hole 130, so that the core 12 contacts the movable end 320 and the bend portion 230 of the conductive terminal 200.

Figure 7:
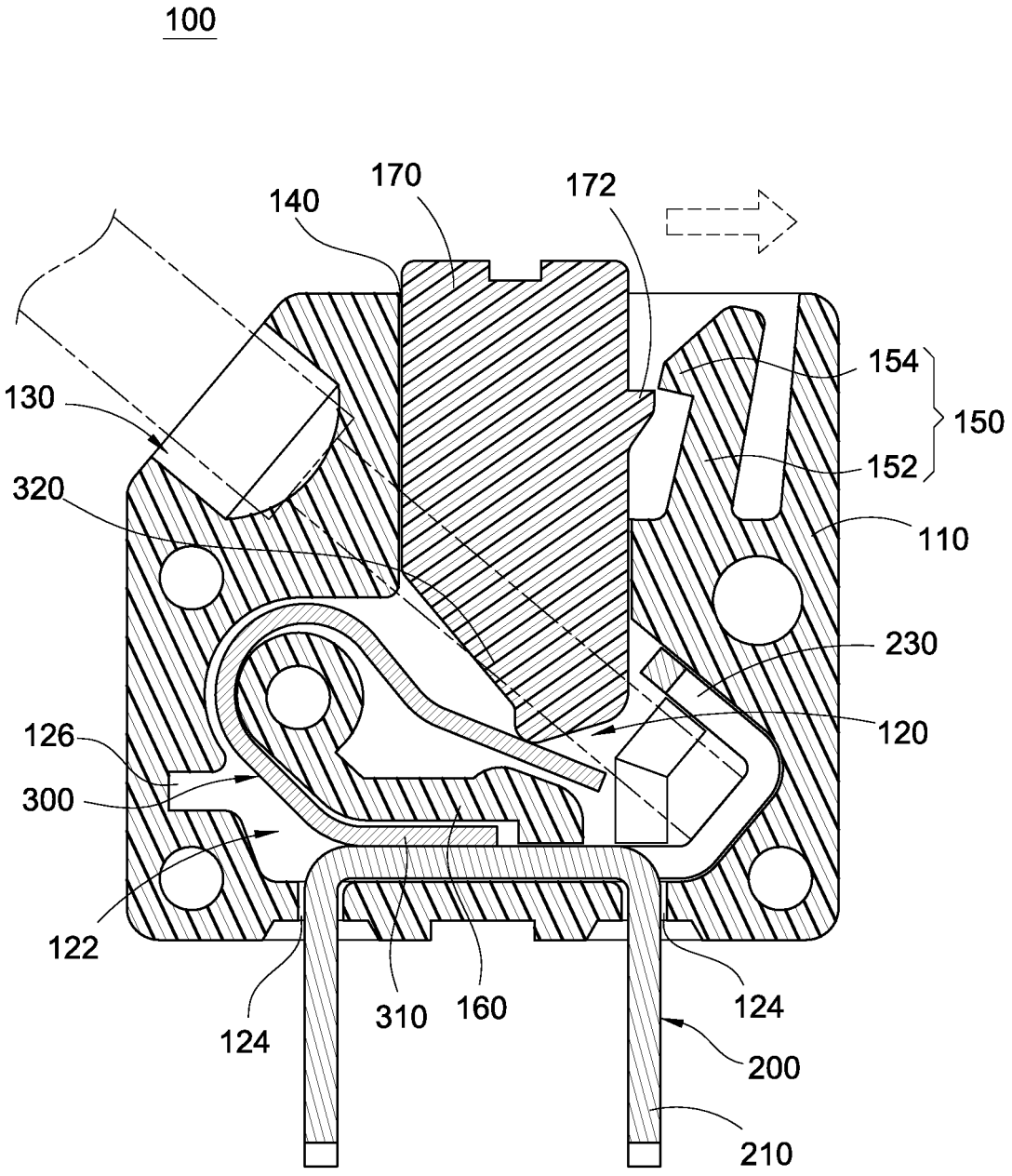
FIG. 7 is a cross-sectional view of the present invention, illustrating the hook element disengaged from the press block.

Referring to FIG. 7, cable arrangement is completed after stopping pressing the press block 170, and the inserted core 12 is clamped by the metal elastic element 300 and the conductive terminal 200. During this process, it is required to move the hook element 150 by, for example, a finger or a screwdriver, so as to release the clasp portion 154 from the restriction of the engagement point 172. Please refer to FIG. 8, the press block 170 returns to an original position, and the core 12 is clamped between the movable end 320 of the metal elastic element 300 and the barb portion 232 of the bend portion 230.

By engagement of the press block 170 with the hook element 150, the present invention obviates the necessity of pressing the press block 170 with one hand and inserting the cable 10 with the other hand as the conventional technique does and makes inserting the cable 10 (i.e. cable arrangement) time and labor saving in a flexible way. Furthermore, after completely inserting the cable 10, if the cable 10 is misarranged, the misarranged cable 10 can be taken out quickly and conveniently for replacement/rearrangement.

Figure 9:
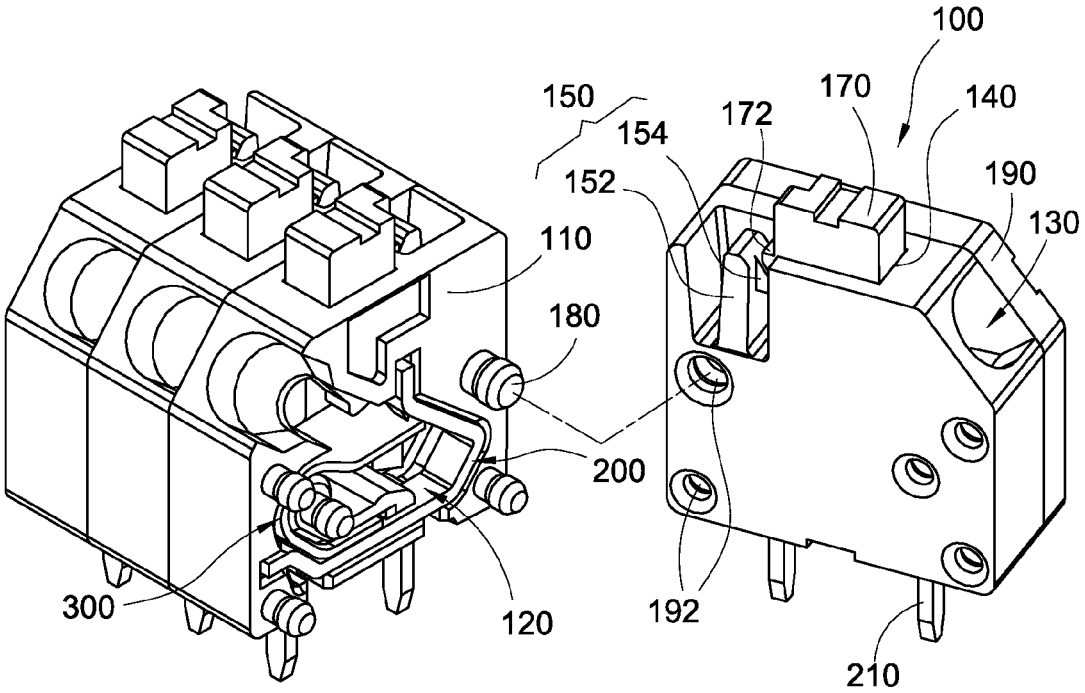
FIG. 9 is an exploded view according to a second embodiment of the present invention.
Figure 10:
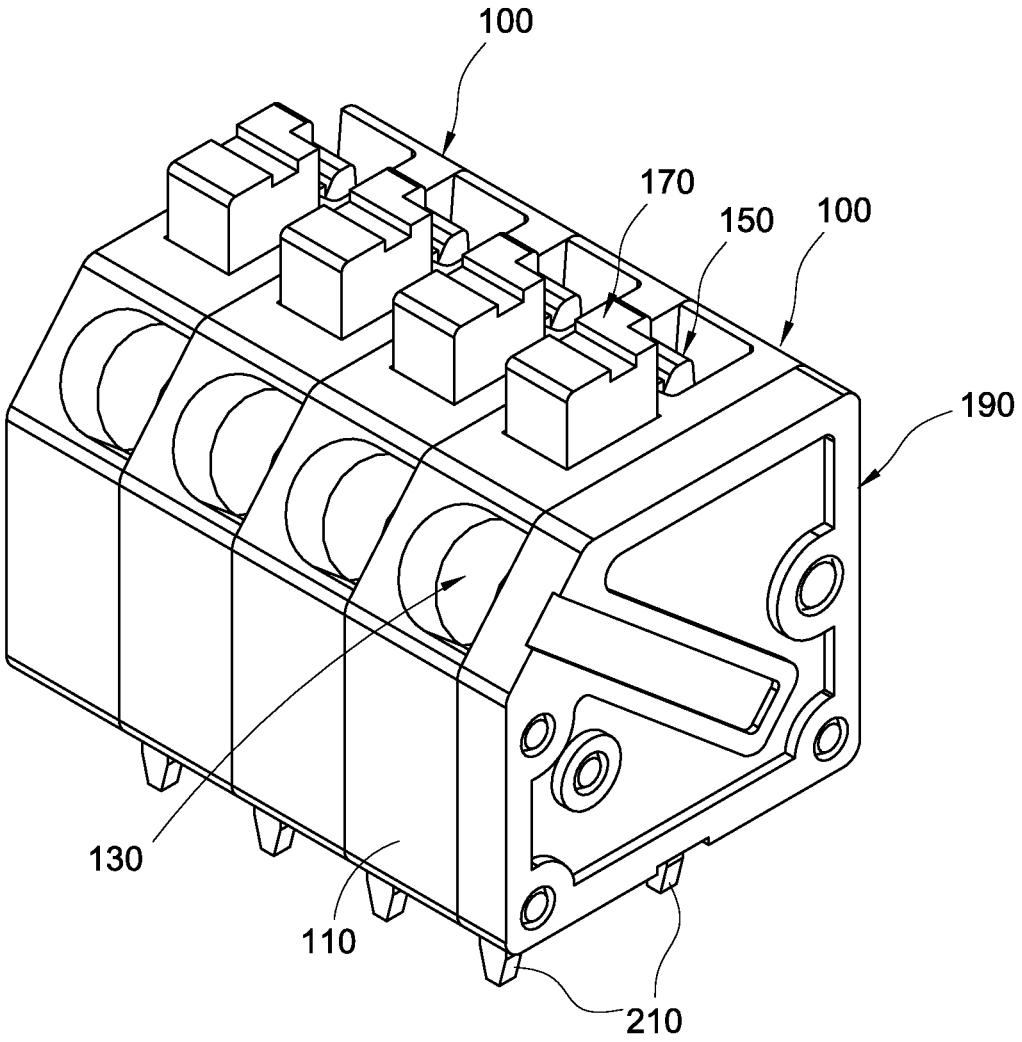
FIG. 10 is a perspective view according to the second embodiment of the present invention.

FIGS. 9 and 10 are an exploded view and a perspective view according to a second embodiment of the present invention. In this embodiment, a plurality of the terminal bases 100 and a side cover 190 are assembled together. As shown in the drawing, one side of the side cover 190 includes a plurality of assembly holes 192, and one side of the body 110 includes a plurality of assembly pillars 180 for assembled in the assembly holes 192. Each terminal base 100 further includes a plurality of the assembly holes 192 (not illustrated) in the other side opposite to the assembly pillars 180, so that the terminal bases 100 can be assembled together.

When there is a need to insert multiple cables 10, the engagement of the press block 170 with the clasp element 150 allows the cables to be inserted quickly and conveniently, thereby making the insertion operation time and labor saving in a flexible way. Besides, in this embodiment, if any cable is misarranged, the misarranged cable 10 can be taken out quickly and conveniently for replacement/rearrangement.

Figure 11:
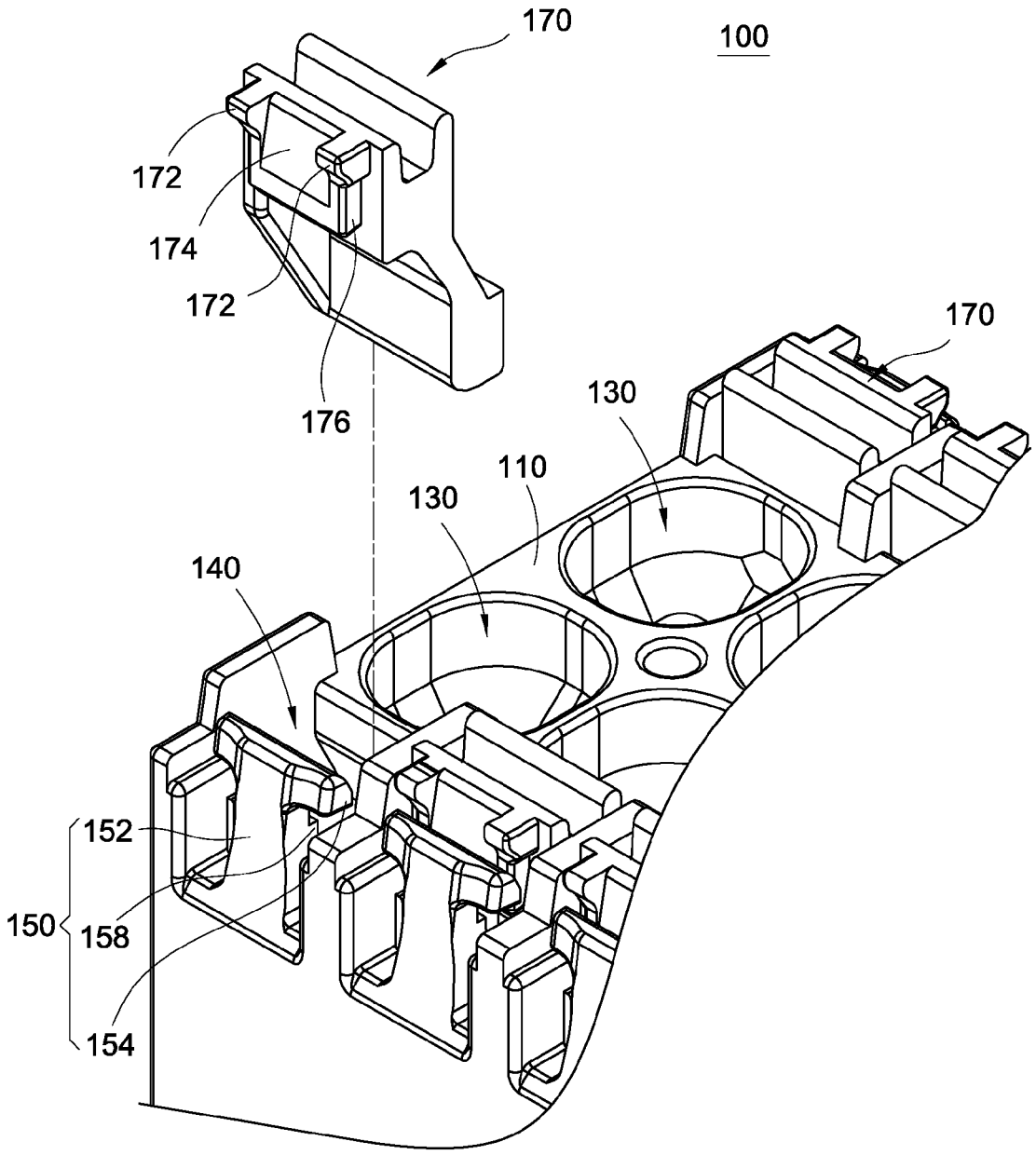
FIG. 11 is a partial exploded view illustrating a third embodiment of the present invention.
Figure 12:
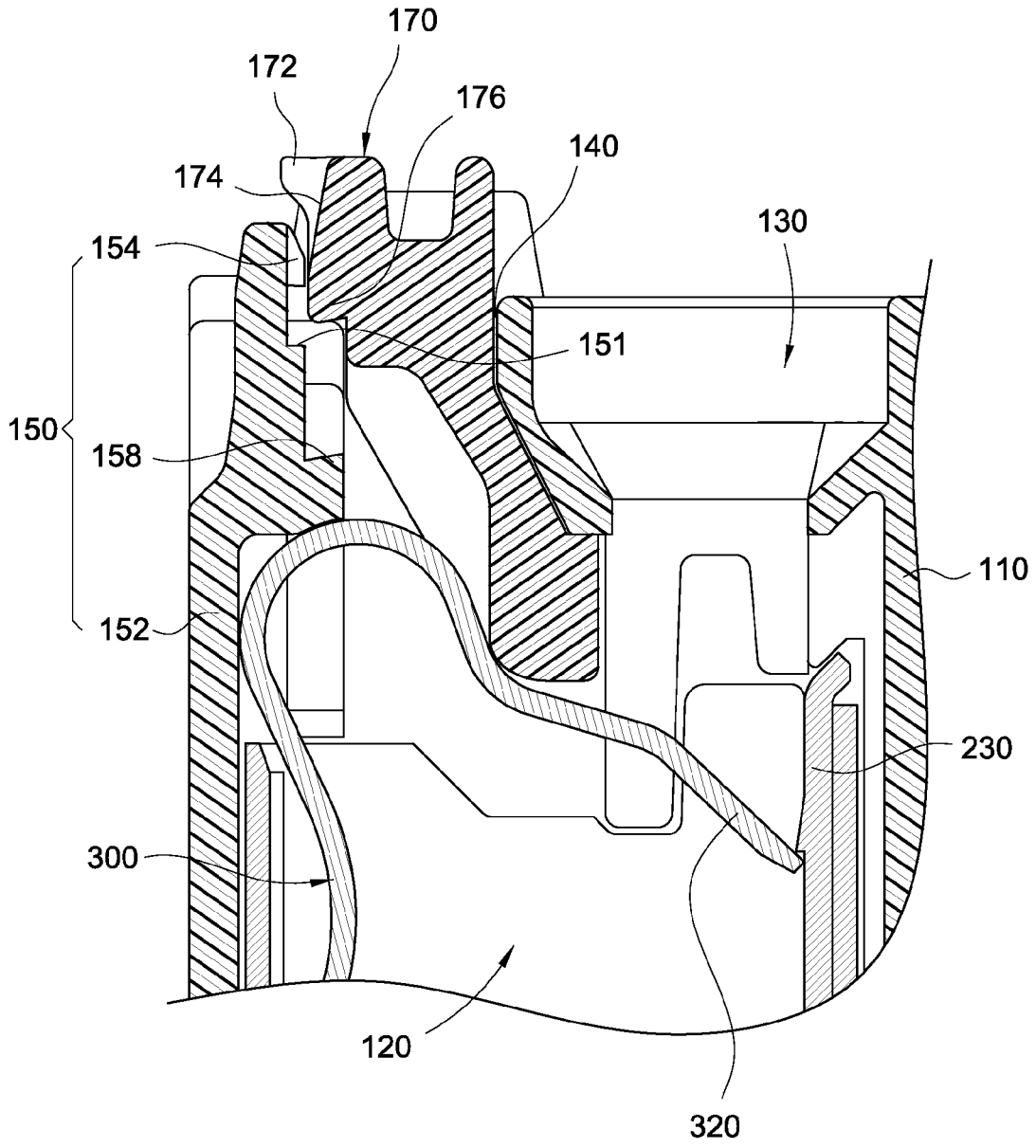
FIG. 12 is a cross-sectional view illustrating the third embodiment of the present invention.
Figure 13:
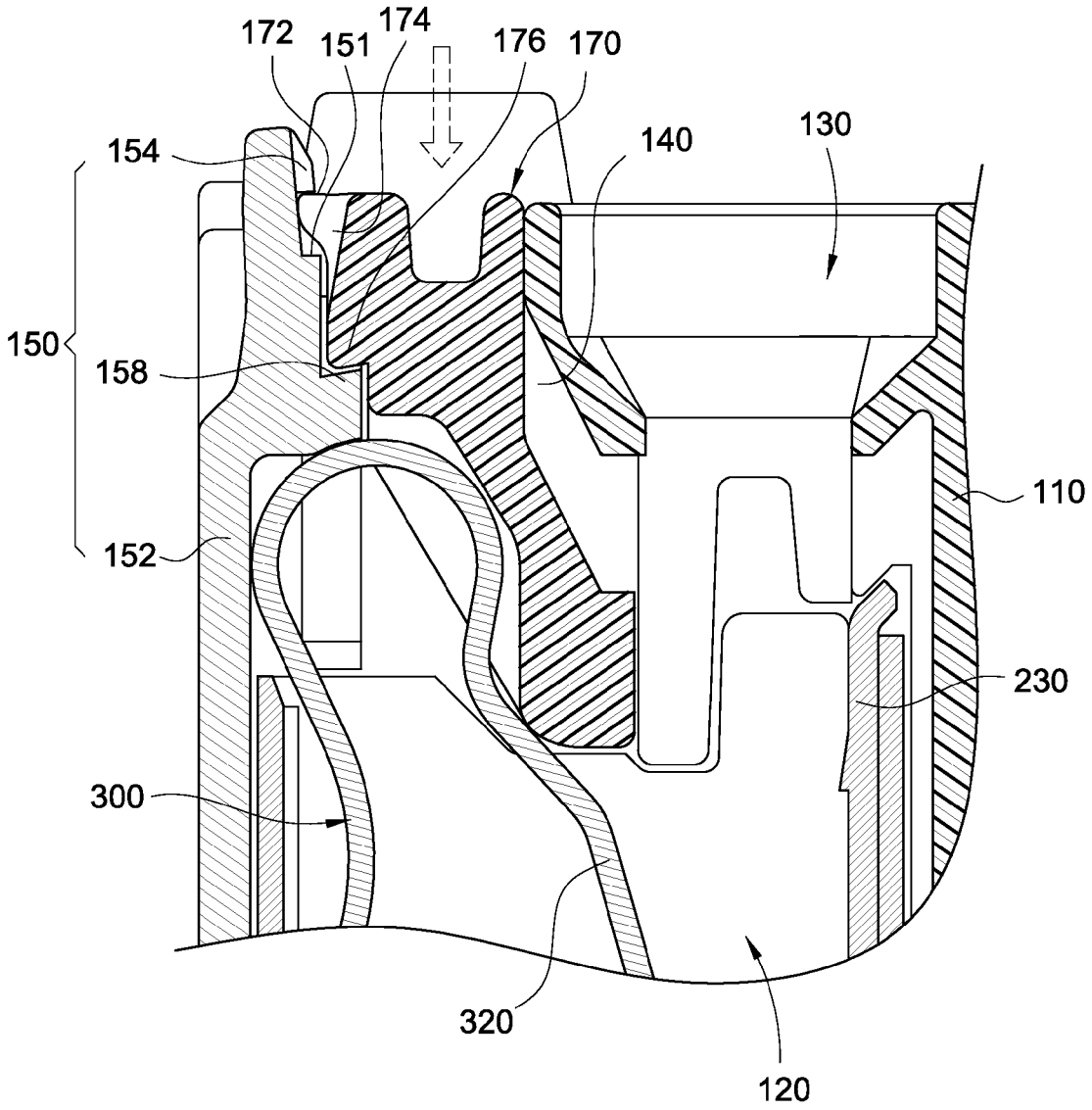
FIG. 13 is another cross-sectional view illustrating the third embodiment of the present invention.
Figure 14:
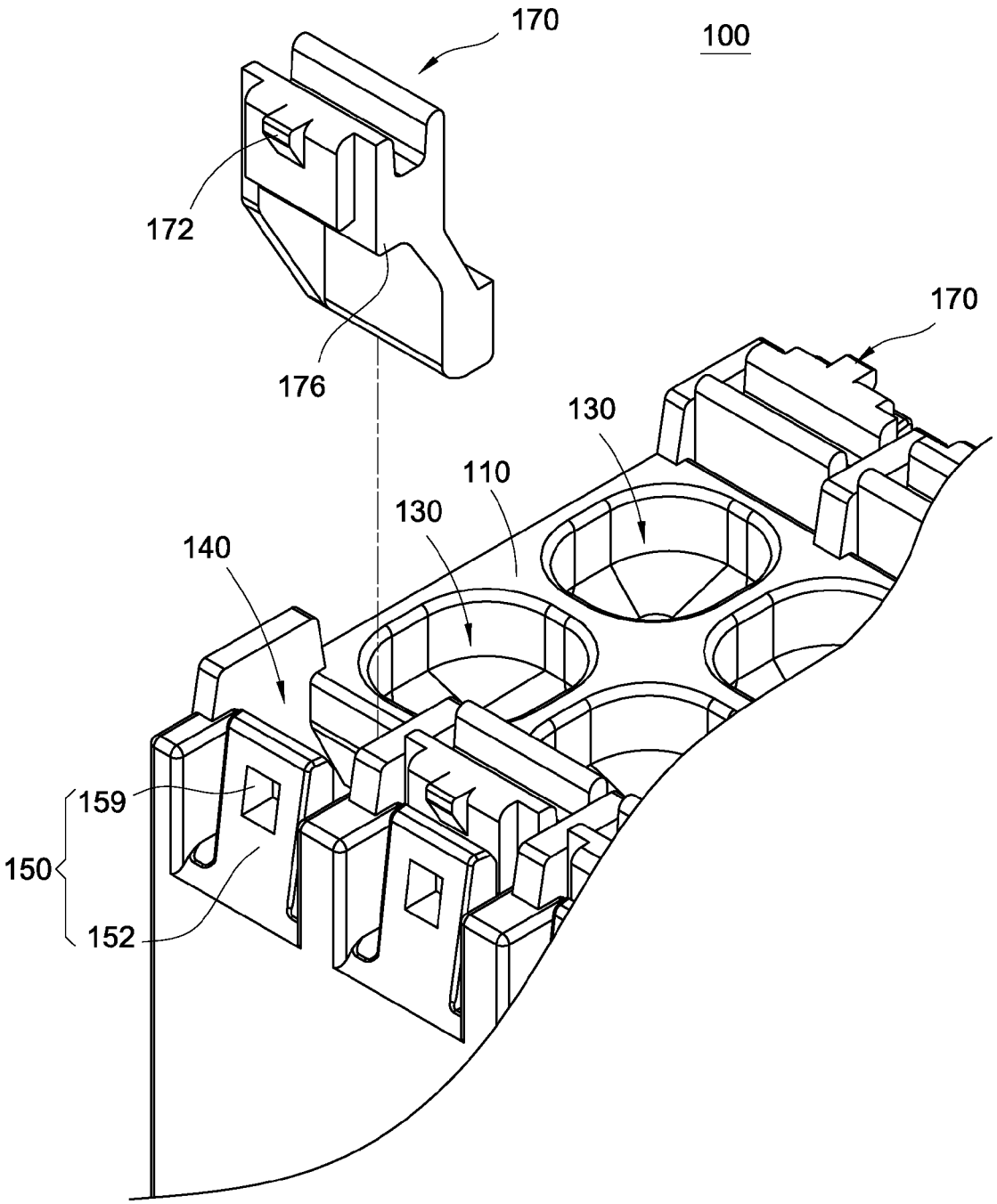
FIG. 14 is a partial exploded view illustrating a fourth embodiment of the present invention.

Please refer to FIGS. 11 to 13 which show a third embodiment of the present invention. The press block 170 includes two engagement points 172 spaced apart from each other and an inclined recess 174 between the two engagement points 172. The hook portion 150 of the body 110 includes an extension rod 152 and two clasp portions 154 connected to the extension rod 152, and each of the engagement points 172 is disposed corresponding to each of the clasp portions 154 to be engaged with the same.

The hook element 150 is a T-shaped structure, and each of the clasp portions 154 is disposed at two ends of a head portion of the T-shaped structure. The press block 170 further includes a limiting block 176, and the hook element 150 further includes a contact block 158 disposed corresponding to the limiting block 176, so as to limit the press block 170 from moving toward the accommodating space 120 from the receiving hole 140. Furthermore, the extension rod 152 of the hook element 150 further includes a step block 151 to limit or prevent hand tools, like preventing the screwdriver from being inserted too deep into the receiving hole 140 or the accommodating space 120. The step block 151 is disposed between the contact block 158 and two clasp portions 154, and the contact block 158 protrudes toward the receiving hole 140 further than the step block 151.

After insertion of the cable (not illustrated) is completed, if the cable is misarranged or is not arranged properly, a hand tool such as the screwdriver can be used to reach from the inclined recess 174 and push the extension rod 152 of the hook element 150, so as to release each of the engagement points 172 from the restriction of each of the clasp portions 154, and thereby the press block 170 is ejected and the misarranged cable 10 can be taken out quickly and conveniently for replacement or rearrangement.

Figure 15:
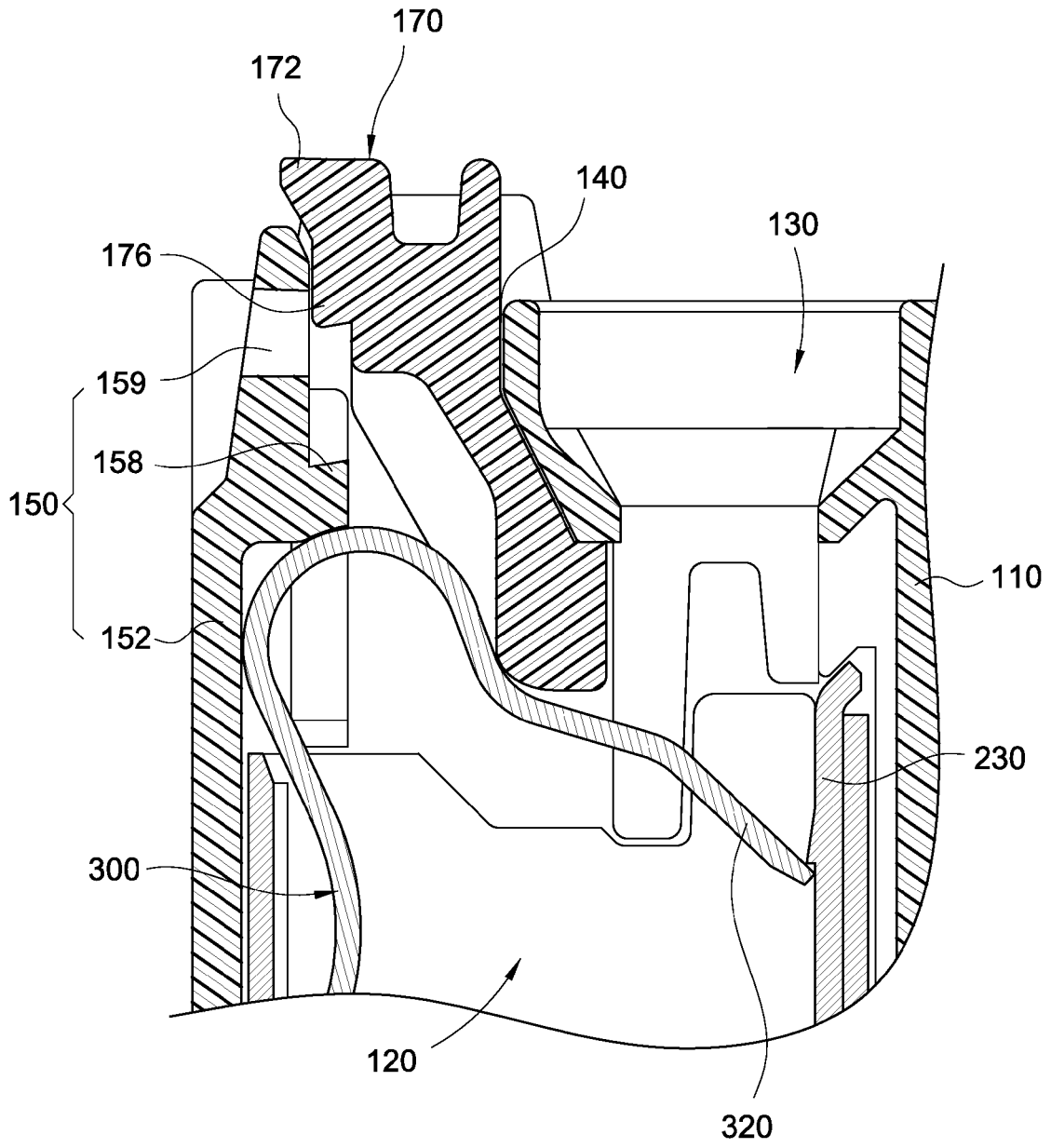
FIG. 15 is a cross-sectional view illustrating the fourth embodiment of the present invention.
Figure 16:
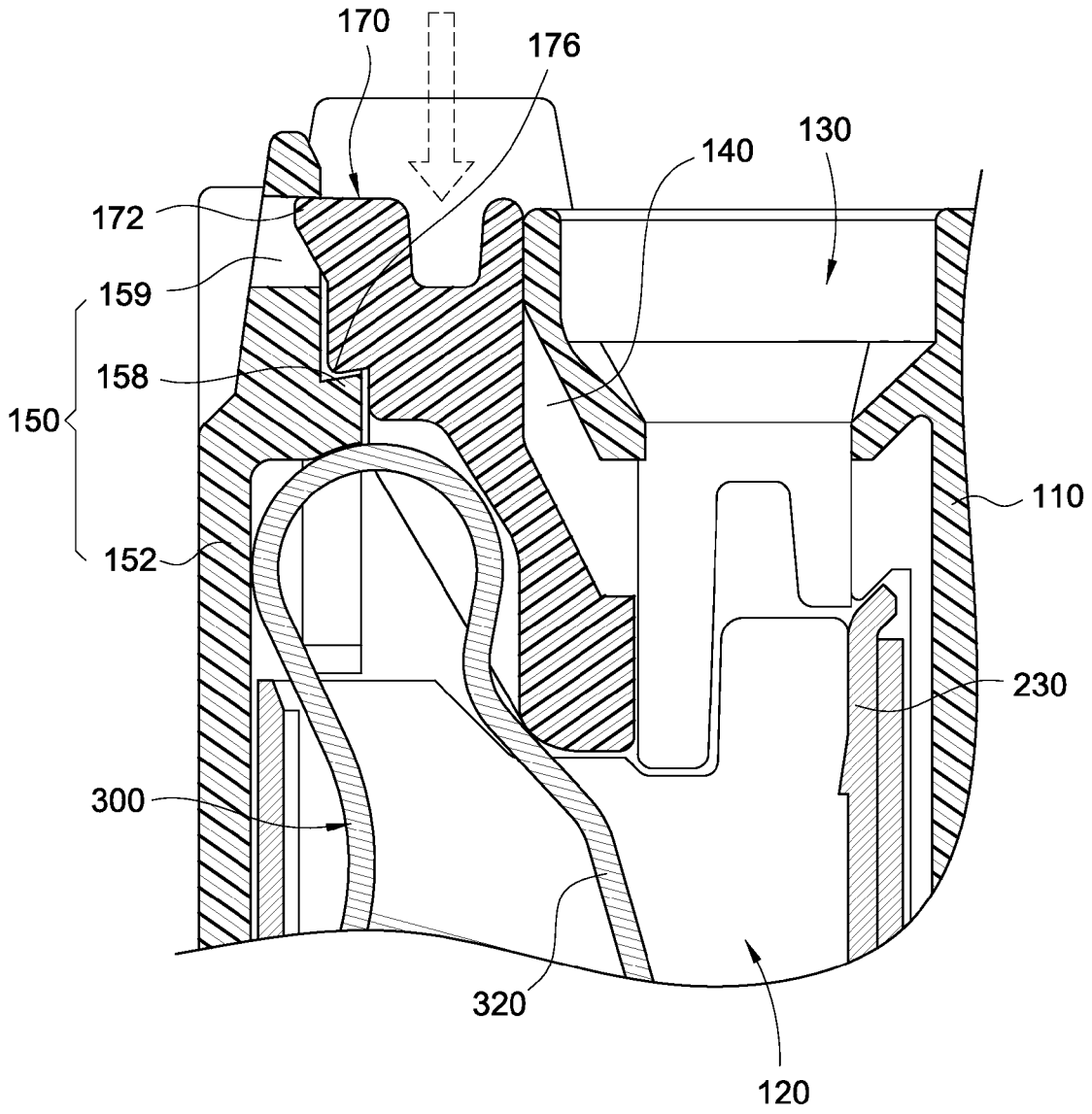
FIG. 16 is another cross-sectional view illustrating the fourth embodiment of the present invention.

Please refer to FIGS. 15 and 16 which show a fourth embodiment of the present invention. In this embodiment, the hook element 150 has an extension rod 152 and a fastening hole 159 formed on the extension rod 152, and the press block 170 includes an engagement point 172 at one side for engagement with the fastening hole 159. Referring to FIG. 16, the press block 170 further includes a limiting block 176, and the hook element 150 includes a contact block 158 disposed corresponding to the limiting block 176, so as to limit the press block 170 from moving toward the accommodating space 120 from the receiving hole 140.

After insertion of the cable (not illustrated) is completed, if the cable is misarranged or is not arranged properly, a finger or a hand tool such as the screwdriver can be used to reach from the fastening hole 159 to disengage the engagement point 172 therefrom so as to eject the press block 170, and thereby the misarranged cable 10 can be taken out quickly and conveniently for replacement or rearrangement.

It is to be understood that the above descriptions are merely the preferable embodiments of the present invention and are not intended to limit the scope of the present invention. Equivalent changes and modifications made in the spirit of the present invention are regarded as falling within the scope of the present invention.

What is claimed is:

1. A terminal base having a fastening structure for collaborating with a cable (10) having a core (12), the terminal base (100) comprising:

a body (110), the body (110) including an accommodating space (120), a wiring hole (130), a receiving hole (140), and a hook element (150) disposed adjacent to the receiving hole (140), the wiring hole (130) and the receiving hole (140) communicating with the accommodating space (120), the hook element (150) being elastically connected to the body (110);

a conductive terminal (200) disposed in the accommodating space (120), the conductive terminal (200) including two leads (210) protruding outside of the body (110);

a metal elastic element (300) disposed inside the accommodating space (120), the metal elastic element (300) including a contact end (310) and a movable end (320), the contact end (310) being in contact with the conductive terminal (200), the movable end (320) being elastically disposed inside the accommodating space (120); and a press block (170) movably disposed in the receiving hole (140), the press block (170) pressing the movable end (320) of the metal elastic element (300) to be engaged with the hook element (150), wherein the body (110) further includes a stopper (160), and the stopper (160) is fixed inside the accommodating space (120) to position the conductive terminal (200).

2. The terminal base having the fastening structure of claim 1, wherein one side surface of the stopper (160) corresponds in shape to the contact end (310) to limit movement of the contact end (310).

3. The terminal base having the fastening structure of claim 1, further comprising a side cover (190) including a plurality of assembly holes (192), wherein the body (110) includes a plurality of assembly pillars (180) for assembled in the assembly holes (192).

4. A terminal base having a fastening structure for collaborating with a cable (10) having a core (12), the terminal base (100) comprising:

a body (110), the body (110) including an accommodating space (120), a wiring hole (130), a receiving hole (140), and a hook element (150) disposed adjacent to the receiving hole (140), the wiring hole (130) and the receiving hole (140) communicating with the accommodating space (120), the hook element (150) being elastically connected to the body (110);

a conductive terminal (200) disposed in the accommodating space (120), the conductive terminal (200) including two leads (210) protruding outside of the body (110);

a metal elastic element (300) disposed inside the accommodating space (120), the metal elastic element (300) including a contact end (310) and a movable end (320), the contact end (310) being in contact with the conductive terminal (200), the movable end (320) being elastically disposed inside the accommodating space (120); and a press block (170) movably disposed in the receiving hole (140), the press block (170) pressing the movable end (320) of the metal elastic element (300) to be engaged with the hook element (150), wherein the hook element (150) includes an extension rod (152) and a clasp portion (154) connected to the extension rod (152), and the press block (170) includes an engagement point (172) at one side for engaged with the clasp portion (154).

5. The terminal base having the fastening structure of claim 4, wherein the clasp portion (154) includes a first inclined surface (156), the press block (170) includes a second inclined surface (178) disposed corresponding to the first inclined surface (156).

6. A terminal base having a fastening structure for collaborating with a cable (10) having a core (12), the terminal base (100) comprising:

a body (110), the body (110) including an accommodating space (120), a wiring hole (130), a receiving hole (140), and a hook element (150) disposed adjacent to the receiving hole (140), the wiring hole (130) and the receiving hole (140) communicating with the accommodating space (120), the hook element (150) being elastically connected to the body (110);

a conductive terminal (200) disposed in the accommodating space (120), the conductive terminal (200) including two leads (210) protruding outside of the body (110);

a metal elastic element (300) disposed inside the accommodating space (120), the metal elastic element (300) including a contact end (310) and a movable end (320), the contact end (310) being in contact with the conductive terminal (200), the movable end (320) being elastically disposed inside the accommodating space (120); and a press block (170) movably disposed in the receiving hole (140), the press block (170) pressing the movable end (320) of the metal elastic element (300) to be engaged with the hook element (150), wherein the press block (170) includes two engagement points (172) spaced apart from each other and an inclined recess (174) between the two engagement points (172), the hook portion (150) includes an extension rod (152) and two clasp portions (154) connected to the extension rod (152), and each of the engagement points (172) is disposed corresponding to each of the clasp portions (154) to be engaged with the same.

7. The terminal base having the fastening structure of claim 6, wherein the hook element (150) is a T-shaped structure, and each of the clasp portions (154) is disposed at two ends of a head portion of the T-shaped structure.

8. The terminal base having the fastening structure of claim 6, wherein the press block (170) further includes a limiting block (176), and the hook element (150) further includes a contact block (158) disposed corresponding to the limiting block (176).

9. The terminal base having the fastening structure of claim 8, wherein the extension rod (152) of the hook element (150) further includes a step block (151), the step block (151) is disposed between the contact block (158) and two clasp portions (154), and the contact block (158) protrudes toward the receiving hole (140) further than the step block (151).

10. A terminal base having a fastening structure for collaborating with a cable (10) having a core (12), the terminal base (100) comprising:

a body (110), the body (110) including an accommodating space (120), a wiring hole (130), a receiving hole (140), and a hook element (150) disposed adjacent to the receiving hole (140), the wiring hole (130) and the receiving hole (140) communicating with the accommodating space (120), the hook element (150) being elastically connected to the body (110);

a conductive terminal (200) disposed in the accommodating space (120), the conductive terminal (200) including two leads (210) protruding outside of the body (110);

a metal elastic element (300) disposed inside the accommodating space (120), the metal elastic element (300) including a contact end (310) and a movable end (320), the contact end (310) being in contact with the conductive terminal (200), the movable end (320) being elastically disposed inside the accommodating space (120); and a press block (170) movably disposed in the receiving hole (140), the press block (170) pressing the movable end (320) of the metal elastic element (300) to be engaged with the hook element (150), wherein the hook element (150) has an extension rod (152) and a fastening hole (159) formed on the extension rod (152), and the press block (170) includes an engagement point (172) at one side for engagement with the fastening hole (159).

11. The terminal base having the fastening structure of claim 10, wherein the press block (170) further includes a limiting block (176), and the hook element (150) includes a contact block (158) disposed corresponding to the limiting block (176).

* * * * *